US006299034B1

(12) United States Patent
Tancheff

(10) Patent No.: US 6,299,034 B1
(45) Date of Patent: Oct. 9, 2001

(54) DISPENSER OUTLET

(76) Inventor: Brian Tancheff, 15 Broadbeach Road, 3925 Cape Woolamai (AU)

( * ) Notice: Subject to any disclaimer, the term of this patent is extended or adjusted under 35 U.S.C. 154(b) by 0 days.

(21) Appl. No.: 09/424,111

(22) PCT Filed: May 21, 1998

(86) PCT No.: PCT/AU98/00377

§ 371 Date: Nov. 18, 1999

§ 102(e) Date: Nov. 18, 1999

(87) PCT Pub. No.: WO98/52696

PCT Pub. Date: Nov. 26, 1998

(30) Foreign Application Priority Data

May 21, 1997 (AU) ..... PO 6928

(51) Int. Cl.[7] ..... B65D 47/00
(52) U.S. Cl. ..... 222/502
(58) Field of Search ..... 222/502

(56) References Cited

U.S. PATENT DOCUMENTS 2,309,895 * 2/1943 Griffith ..... 222/502
2,665,826 * 1/1954 Mahoney ..... 222/502
2,901,152 * 8/1959 Wahnsiedler ..... 222/502
4,108,338 * 8/1978 Howland et al. ..... 222/502
4,546,906 * 10/1985 Vadnais ..... 222/502

FOREIGN PATENT DOCUMENTS

25524/71 7/1972 (AU) .
4005350 A 8/1991 (DE) .
2622814 A 5/1989 (FR) .
2299529A 10/1996 (GB) .
WO98/15386 A 6/1998 (WO) .

* cited by examiner

*Primary Examiner*—Kevin Shaver
*Assistant Examiner*—David A. Bonderer
(74) *Attorney, Agent, or Firm*—Alfred M. Walker

(57) ABSTRACT

A dispenser outlet including a nozzle (15) having at least partly tapering sides (21) leading to a nozzle outlet (23) at the tip to allow for accurate dispensing of material, the nozzle (15) having an opening (25) in one or more of the sides of the nozzle to assist removal of blocking material from the nozzle (15); and a sleeve (27) which in one position is able to substantially close the opening (25) but allow dispensing through the tip and which in a second position allows access to the opening (25) and to the inside of the nozzle (15) to assist removal of blocking material from the nozzle (15).

13 Claims, 4 Drawing Sheets

DISPENSER OUTLET

TECHNICAL FIELD

This invention relates to a dispenser outlet.

In one particularly important field of use of the invention, the dispenser outlet can be used for example with piston rod dispensers and tubes of caulking material where the piston rod forces a piston down the tube forcing expulsion of the material through an outlet in the other end of the tube connected or fixed to a dispenser outlet. However, the invention is not limited to use with tubes of caulking materials.

BACKGROUND ART

Most caulking materials gradually set hard upon contact with the air over a period of time. It is therefore important to keep the material away from the air. This is achieved by a decreasing volume dispenser such as a piston dispenser moving a piston at one end of a tube holding the caulking material. At the other end of the tube is an outlet to which a conically tapering tubular nozzle, usually of plastic, is attached by screw thread. The caulking tubes are purchased with the outlet having a frangible seal so as to prevent the contents from being affected by the atmosphere prior to first use and allow the contents to remain substantially in liquid or viscous form and have a reasonably long shelf life. Materials used are selected such that they are readily applied in viscous liquid form but by contact with air harden or set so as to provide the required caulking. At the end of the tube distal to the outlet is a slidable piston.

The contents of the caulking tube are used by inserting it into a caulking gun so that the nozzle extends from one end of the gun. The caulking gun includes means for forcing a piston rod to move the piston of the tube within the tube and effect expelling or excretion of the contents of the tube out through the nozzle. A trigger mechanism is often employed with the caulking gun which actuates a ratchet mechanism to advance the piston rod engaging the piston to force the caulking material out through the nozzle.

However the material remaining in the nozzle must be in liquid or viscous form or the nozzle outlet will become blocked. Due to the taper and single small nozzle outlet there is the benefit that the material can be dispensed precisely into the required position through the end of the nozzle. The smallness of the nozzle outlet though is also detrimental since it takes very little material to harden in contact with the air in order to block the nozzle outlet. It is therefore important to be able to clear a blocked nozzle.

Generally in known arrangements the nozzle is screwed onto the barrel and is merely a conically tapering tubular plastic nozzle having a single outlet at the tip of the taper. Although users undertaking small "do-it-yourself" projects may have time to disengage the nozzle, clean it by forcing any hardened material back out the larger end of the conically tapering tubular nozzle and reattach the nozzle, professionals using the equipment extensively require their equipment to be always useable and to avoid contamination of the viscous material by small bits of hardened material that may be able to be expelled through the tip of tile nozzle. Often professionals will have a number of nozzles and merely dispose of any blocked nozzle rather than cleaning the nozzle. The professional will use a large number of nozzles without ever using any one nozzle for its entire useful lifetime Whether the nozzle is being cleaned or being replaced there is also a large loss of material since the entire contents of the nozzle must be discarded in each of these cleaning methods although only the material at the tip of the nozzle may have hardened.

Many types of nozzles have been devised and shown in the patent literature. However, few documents disclose apparatus that simplify cleaning and reusing of a nozzle. They include published international patent no. WO 93/24030 showing an enamel applicator and doser plug in which a lever arm pushes a central pin down the nozzle to force liquid through the nozzle; patent No. JP 60-255163 showing a cylindrical stirring nozzle for a different purpose of a two component adhesive and which opens in half along an entire longitudinal seam for removal of all of the unused two components in the nozzle since all will have hardened in the internal pockets of the nozzle when the two components were mixed. However the nozzle does not allow part cleaning without allowing air contact with the rest of the material in the nozzle and is very likely to break or not properly close for reuse; and published Australian patent application no. AU-A-56253/96 for a nozzle with two nozzle parts that attach end to end but is very similar to unscrewing a standard nozzle to clean.

Some published patent documents show a slit in a nozzle for particular means of applying a liquid in a particular way such as U.S. Pat. No. 5,553,758—nozzle adaptor for applying hot melt adhesive; WO 97/41968—deposition of beads of material; WO 96/404—45 article for applying and spreading viscous material and method thereof; U.S. Pat. No. 5,059,050—dispenser for hair treatment solutions; AU-A-74044/87—pen-like dispenser for applying rust converting liquid; and WO 96/33025—silicone paint brush artist's tool.

Another group of documents disclose caps for nozzles but particularly caps allowing variable amount of flow such as U.S. Pat. No. 4,967,941—twist lock adjustable metering closure cap; and U.S. Pat. No. 4,213,546—cap for the nozzle of a caulking cartridge. However none of these documents show a means of cleaning and reuse of the nozzle.

DISCLOSURE OF INVENTION

It is an object of the invention to provide a dispenser outlet which is easily and quickly cleanable so as to reduce the need for replacement nozzles and with minimal loss of useable material from the nozzle.

In accordance with the invention there is provided a dispenser outlet having a nozzle with a nozzle outlet and an opening extending along at least part of one or more of the sides of the nozzle to allow removal of blocking material from the nozzle, and a sleeve fitting at least partially over the nozzle and which in a first position substantially closes the opening while allowing dispensing through the nozzle outlet and which in a second position allows access to the inside of the nozzle and removal of blocking material from the nozzle.

The invention also provides a dispenser outlet including a nozzle and a sleeve, the nozzle having an entry opening for receiving viscous material and a nozzle outlet at a tip of the nozzle for expulsion of the viscous material, the nozzle further including elongated slits extending from the nozzle outlet; the sleeve able to extend over the nozzle so as to substantially cover the slits and allow expulsion of the viscous material substantially only from the nozzle outlet; wherein the dispenser outlet allows access to the cent ie of the nozzle by removal of the sleeve and resilient deformation of the slitted nozzle to allow removal of unusable material from the nozzle substantially through the end of the nozzle having the nozzle outlet and allows normal expulsion of the viscous liquid through the nozzle outlet when the sleeve is in place.

The invention thereby allows the dispenser outlet to be made reusable by enabling easy removal of hardened material that will first build up next to the outlet of the nozzle. In particular, one form of the invention allows removal of the hardened material in a direction away from the useable material so as to not require removal of the hardened material through the useable material and not risk contamination of the useable material by the implement used to remove the hardened material. The dispenser outlet also provides the benefit of not requiring the loss of all of the material in the nozzle which amounts to a substantial saving in material. However, the nozzle and sleeve combination still allows for accurate expulsion of the material only through the outlet of the nozzle.

The opening may be adjacent the nozzle outlet at the nozzle tip and may even extend from the nozzle tip as a substantially longitudinal slit. The nozzle may include a pair of opposing longitudinal slits which together with the flexibility and resilience of the nozzle end allows for the tapering sides to be flexibly opened like a pair of jaws to allow for easy removal of blocking material from the end of the tip.

The sleeve may vary according to the size or shape of the opening and may be fully removable from the nozzle or remain mounted on the nozzle but moved from a first to a second position such that in the first position the opening is closed and in the second position the opening is accessible.

In one form the sleeve can be removably mounted on the nozzle by the sleeve having open ends and complementary sides to an end part of the nozzle adjacent the nozzle outlet. The sleeve may include a covering part which closes the opening of the nozzle to minimise the air hardening of the material in the end of the nozzle. The sleeve may be a similar shape to the tapered sides of the nozzle and have complementary mounting portions at the end away from the open end of the sleeve corresponding with the outlet of the nozzle, so as to engagedly hold the sleeve on the nozzle.

Alternatively, the sleeve may have one or more flaps which are positioned on the nozzle adjacent the outlet in the nozzle by being fixedly attached, such as hinges attached to the nozzle sides, or movable or removable from the nozzle. The flaps may comprise covering portions on a fixed sleeve structure which is rotatable or otherwise movably mountable on the nozzle and may remain mounted on the nozzle in the first or second position. The slidable or rotatable or other construction allows for movement from the first to the second position so as to close the opening of the nozzle while allowing access to the opening of the nozzle. The flaps may be resilient flaps which push towards the openings so as to counteract the tapering of the sides and provide a closing fit of the openings on the side of the nozzle. The sleeve structure may have a similar shape to the tapering sides of the nozzle.

BRIEF DESCRIPTION OF DRAWINGS

In order that the invention is more readily understood a particular embodiment thereof will now be described by way of example only with reference to the accompanying drawings wherein.

BEST MODE FOR CARRYING OUT THE INVENTION

Figure 1:
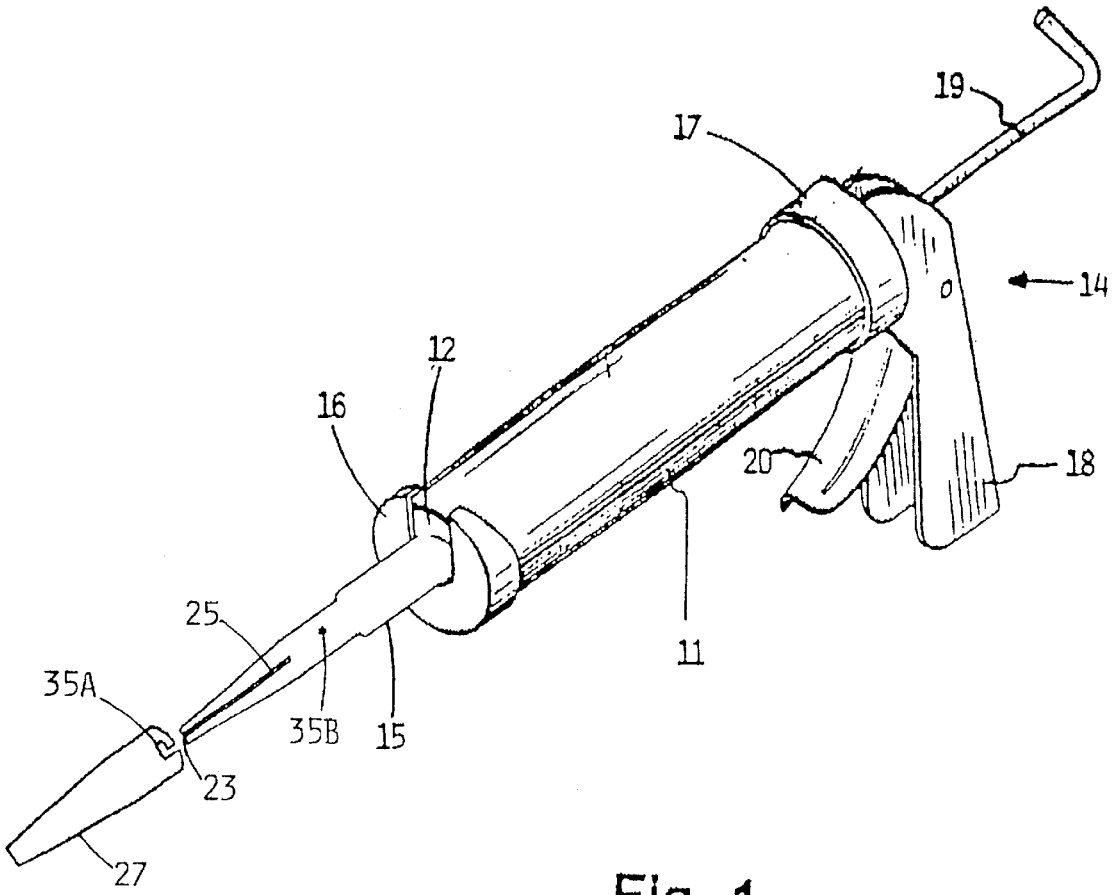
FIG. 1 is a perspective view of a dispensing cylinder with a first embodiment of a nozzle of the invention.
Figure 3:
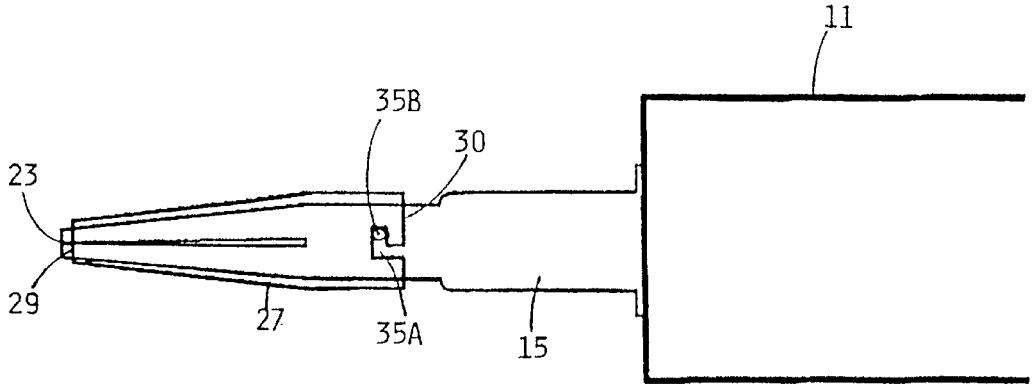
FIG. 3 is a schematic side view of the nozzle with sleeve of FIG. 1.

Referring to the drawings there is shown a dispenser outlet including a nozzle 15 which is attachable to an outlet end 12 of a cylindrical tube 11 containing a settable viscous material. The cylindrical tube 11 is able to be mounted within a dispensing gun 14 having first annular end piece 16 for receiving and holding the outlet end 12 of tile cylindrical tube 11 while allowing the nozzle 15 to protrude therethrough and having a second annular end 17 of a similar size and coaxially fixed at a distance from the first annular end 15 so as to be able to receive the other end of the cylindrical tube 11. The other end of the cylindrical tube 11 includes a piston (not shown) which is able to be pushed through the cylindrical tube 11 to decrease the volume of the tube and force the settable viscous material out of the nozzle 15. The piston is pushed by a piston rod 19 of the dispensing gun 14 connected by a ratchet mechanism to a trigger 20 and handle 18 of the dispensing gun 14 such that gripping and compressing of the trigger 20 relative to the handle 18 forces the piston rod 19 to force the piston through the cylindrical tube 11 and dispense the viscous material out through the nozzle 15.

The nozzle 15 of the invention is tubular with an end part adjacent the nozzle outlet 23 having conically tapering sides 21. The entry opening of the nozzle 15 has a screw thread 22 to allow ready attachment to tile outlet 12 of a cylindrical tube 11. The nozzle 15 further includes a pair of openings in the sides of the nozzle including opposing longitudinal slits 25 extending from the nozzle outlet 23 of the nozzle 15 substantially along a bisecting plane of the nozzle 15 towards the screw threaded end 22. The longitudinal slits 25 have dimensions in accordance with the resilient material of the nozzle 15 so as to allow flexibility of the end of the nozzle 15 near tile nozzle outlet 23 and act as a pair of openable jaws allowing hardened material of the viscous settable material to be removed from the end of the nozzle 15 and thereby unblock the nozzle 15. Alternatively the openings 25 may be sized to merely allow for the hardened material to be removed by hand or by a tool inserted through the openings 25.

To allow dispensing the viscous settable material from the cylindrical tube 11, the dispenser outlet has a sleeve 27 with a similar corresponding shape to the end part of the nozzle 15 but without longitudinal slits 25 and having complementary conically tapering sides 28 leading from a first larger open end 29 to a second smaller open end 30 a the end of the taper. In use the sleeve 27 is mounted on the nozzle in first relative position with the sides 28 of the sleeve 27 covering or closing the longitudinal slits 25 of the nozzle 15 so as to prevent dispensing of the material through the longitudinal slits 25 and retaining the structure of the nozzle 15 and the second open end 30 of the sleeve 27 keeps the nozzle outlet 23 clear thereby allowing dispensing of material only through the nozzle outlet 23. In this way accurate dispensing through the nozzle outlet 23 is achieved.

Figure 2:
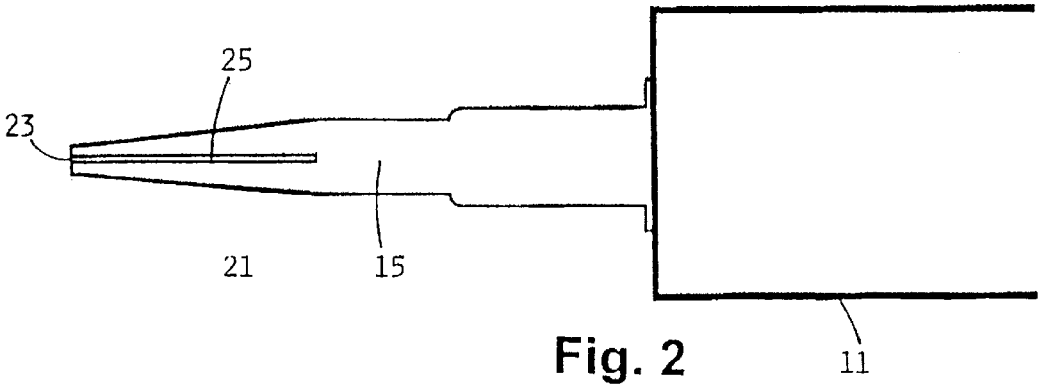
FIG. 2 is a schematic side view of the nozzle of FIG. 1 without the sleeve.
Figure 2A:
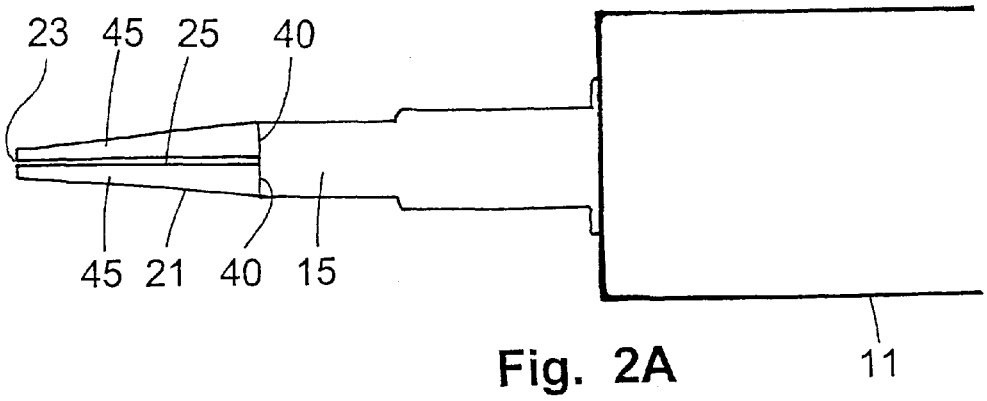
FIG. 2A is a schematic side view of an alternate hinged embodiment, shown in a closed position.
Figure 2B:
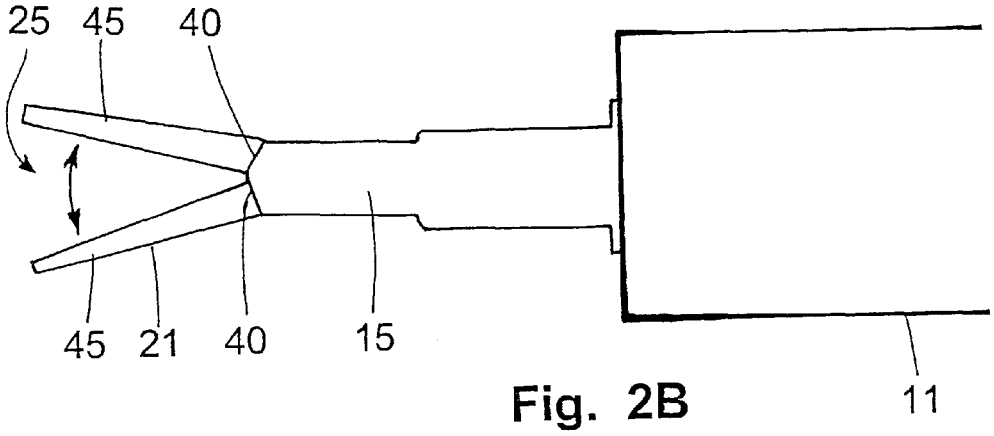
FIG. 2B is a schematic side view of an alternate hinged embodiment, shown in an open position.

FIGS. 2A and 2B show an alternate embodiment wherein nozzle (15) has at least one hinge (40) extending orthogonal to the longitudinally extending slit (25), allowing each side (45) of nozzle (15) to de deflected to allow access to the inside of the nozzle (15).

Figure 4:
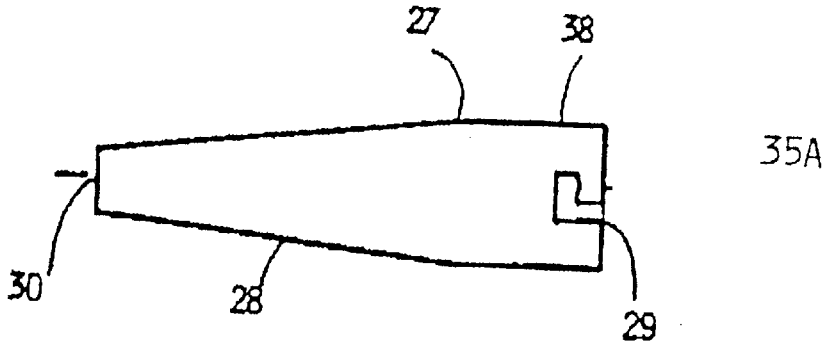
FIG. 4 is side view of tile sleeve of FIG. 1.
Figure 5:
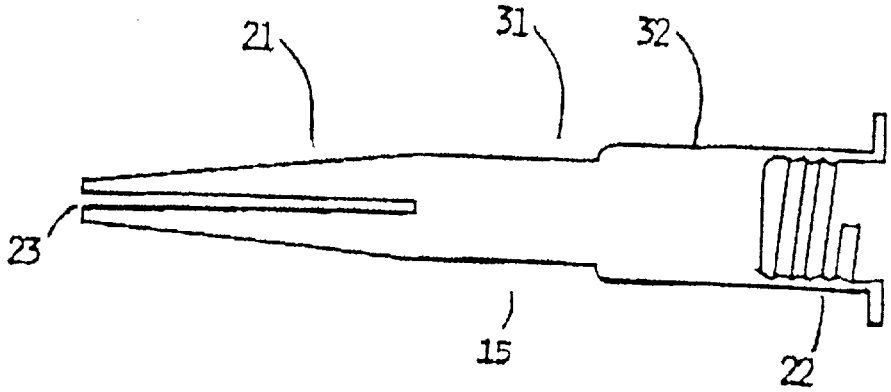
FIG. 5 is a side cut away view of the nozzle only of FIG. 1.

The dispenser outlet in one form as shown in FIGS. 4 and 5 comprises nozzle 15 having at one end the screw threaded end 22 and the other end nozzle outlet 23 at the end of the tapered side 21 include away from the tapered ends complementary engaging parts 35A, 35B in the form of a bayonet fitting having a protrusion 35B on the nozzle that fits in an L-shaped groove 35A on the sleeve 27 and by reason of the taper of the nozzle 15 and sleeve 27 are removably retained in position Alternatively the sleeve 27 can include intermediate thereof substantially cylindrical sides having ribbings radiating therefrom between the screw threaded end 22 partially along the cylindrical side. The parallel cylindrical sides would be able to engage part of the tapered sides 21 of the nozzle 15 so as to hold the sleeve 27 in position. However, other means may be used such as interlocking protuberances on the inside of the sleeve 28 near the open end 29 fitting into grooves in the tapered sides 21 of the nozzle 15 or vice versa.

It should be evident from the description hereinabove that the present invention provides an improved dispenser outlet which avoids most if not all disadvantages of the prior art. Of course many modifications to the above described embodiment may be readily envisaged by persons skilled in the art. For example, the longitudinal slits need not be linear or opposing each other but merely openings allowing access to the inside by the flexibility of the end of the nozzle or allowing material to be pushed out of the opening by an implement extending through the nozzle outlet 23. Further, the sleeve need not be corresponding shape to the nozzle but merely in one position prevent dispensing material through the longitudinal slit. Many different ways of attaching the sleeve to the nozzle can be used and it is possible that the sleeve comprises side flaps integral to the nozzle which are hinged connected to the nozzle to prevent escaping material through longitudinal slits. Alternatively the sleeve is rotatable and includes openings that align with the openings of the nozzle to allow access to the inside of the nozzle.

What is claimed is:

1. A dispenser outlet comprising: a nozzle (15) with a nozzle outlet (23) and at least one longitudinally extending opening slit (25) extending from said nozzle outlet (23) along at least part of at least one of respective sides of said nozzle (15) to allow removal of blocking material from said nozzle (15); and a sleeve (27) fitting at least partially over said nozzle (15), said sleeve (27) having an open dispensing end (30) and which said sleeve (27) in a first position substantially closes said opening slit (25), while retaining said nozzle outlet (23) open (25), said open dispensing end (30) of said sleeve (27) having a diameter substantially equal to that of an end diameter of said nozzle outlet (23) and not extending beyond the nozzle outlet;

wherein said nozzle outlet (23) and said open dispensing end (30) of said sleeve (27) are in positional register, while allowing dispensing through said nozzle outlet (23) and which said sleeve (27) in a second position allows access to an inside of said nozzle (15) and removal of blocking material from said nozzle (15); said sleeve (27) forming a barrier preventing unwanted lateral extrusion of material being dispensed, thus forcing dispensed material to issue from said respective openings (30) and (23) of both said sleeve (27) and the nozzle (15);

wherein further during dispensing use said nozzle (15) is substantially contained within said sleeve (27).

2. A dispenser outlet as claimed in claim 1 wherein at least part of said nozzle (15) is formed from resilient material to allow bending of said nozzle (15) adjacent said at least one slit (25).

3. A dispenser outlet as claimed in claim 1 having two longitudinal slits (25) extending on opposite sides of said nozzle (15).

4. A dispenser outlet as claimed in claim 3 further including a hinge extending orthogonal to said longitudinal slits (25) to allow at least one side of said nozzle (15) between said longitudinal slits (25) to be deflected to allow access to said inside of said nozzle (15).

5. A dispenser outlet as claimed in claim 1 wherein said nozzle (15) comprises a single linear bore able to direct material from a reservoir of material to said nozzle outlet (23).

6. A dispenser outlet as claimed in claim 5 wherein at least part of said nozzle (15) has a symmetrically tapering form extending to said nozzle outlet (23).

7. A dispenser outlet as claimed in claim 1 wherein said nozzle (15) has a substantially conically tapering end part extending to said nozzle outlet (23) and said sleeve (27) has a complementary tapering form allowing for close fitting over said tapering end part of said nozzle (15) and which said sleeve (27) in said first position substantially closes said longitudinal slits (25) while allowing dispensing through said nozzle outlet (23).

8. A dispenser outlet as claimed in claim 1 wherein said opening (25) is sized to allow ready removal of blocking material from said nozzle (15) and said sleeve (27) has side panels which are sized and positioned to be able to close said opening (25) of said nozzle (15) when in said first position but allow access to said opening (25) when in said second position.

9. A dispenser outlet as claimed in claim 1 wherein said sleeve (27) is open ended at both ends such that said sleeve (27) is removably attached to said nozzle (15) and in said first position when mounted on said nozzle (15) substantially closes said opening (25) while allowing dispensing through said nozzle outlet (23).

10. A dispenser outlet as claimed in claim 9 wherein said sleeve (27) is attached to said nozzle (15) by complementary engaging parts on said nozzle (15) and said sleeve.

11. A dispenser outlet as claimed in claim 1 wherein said sleeve (27) remains mounted on said nozzle (15) but said sleeve (15) moves relative to said nozzle (15) between said first and second positions.

12. A dispenser outlet as claimed in claim 1 wherein said dispenser outlet is removably attachable to a cylindrical tube (11) containing settable viscous material.

13. A dispenser outlet as claimed in claim 1 wherein said dispenser outlet is integral with a cylindrical tube (11) containing settable viscous material.

* * * * *